US005791411A

United States Patent [19]

Ricalton et al.

[11] Patent Number: 5,791,411

[45] Date of Patent: Aug. 11, 1998

[54] WELLHEAD STUFFING BOX FOR ROTATING ROD STRING

[75] Inventors: Dale Ricalton, Edmonton; Raymond Rivard, Beaumont, both of Canada

[73] Assignees: Highland/Corod Inc.; Springer Machine Ltd., both of Alberta, Canada

[21] Appl. No.: 617,151

[22] Filed: Mar. 18, 1996

[51] Int. Cl.[6] ..... E21B 33/03

[52] U.S. Cl. ..... 166/84.1; 166/68.5; 277/31

[58] Field of Search ..... 166/84.3, 84.2, 166/84.1, 84.5, 84.4, 78.1, 68.5; 175/195; 277/31

[56] References Cited

U.S. PATENT DOCUMENTS

| | | | |
|---|---|---|---|
| 1,679,962 | 8/1928 | Crans | 277/31 |
| 2,126,007 | 8/1938 | Guiberson et al. | 277/31 |
| 2,333,847 | 11/1943 | Deely | 175/195 X |
| 2,675,994 | 4/1954 | Smith et al. | 175/195 X |
| 2,846,247 | 8/1958 | Davis | 277/31 X |
| 5,370,179 | 12/1994 | Mills | 166/68.5 |
| 5,401,104 | 3/1995 | Newton . | |

FOREIGN PATENT DOCUMENTS

| | | |
|---|---|---|
| 2028555 | 6/1921 | Canada . |

*Primary Examiner*—Hoang C. Dang

*Attorney, Agent, or Firm*—Millen, White, Zelano & Branigan, P.C.

[57] ABSTRACT

A tubular mandrel is provided as a sleeve around the portion of the rod string polish rod extending through the stuffing box housing. The mandrel is coupled to the polish rod so that they rotate together. Bearings stabilize the mandrel within the housing. Stationary rotary seal means are provided in the housing to seal against the now-stabilized mandrel. Leakage and seal wear are improved when compared with the prior art approach of using compressed packing in direct contact with the polish rod to provide the rotary seal.

2 Claims, 2 Drawing Sheets

WELLHEAD STUFFING BOX FOR ROTATING ROD STRING

FIELD OF THE INVENTION

This invention relates to a wellhead stuffing box for sealing around rotating rod string.

BACKGROUND OF THE INVENTION

A conventional stuffing box is a standard wellhead device used to provide an axial seal around the polish rod of a rod string driving the downhole pump. This prior art stuffing box comprises a generally tubular housing that is threaded onto an upwardly projecting tubular pin or connector forming part of the wellhead. The polish rod extends through the wellhead, pin and stuffing box housing. The housing has a greater inside diameter than the outside diameter of the polish rod. Therefore an annular chamber is formed between them. A stack of annular, compressible packing rings are positioned in the annular chamber. The housing forms an internal radial shoulder which supports the stack at its bottom end. An annular packing gland is positioned at the top of the stack. An internally threaded, annular compression nut is then threaded onto the externally threaded upper end of the housing. The compression nut and packing gland can be advanced downwardly to compress the packing against the housing's radial shoulder. As a result, the packing rings are squeezed out radially, so that they seal against the rod string and the inside surface of the housing.

Axial leakage and packing wear have always been a problem with stuffing boxes. The rod string is never perfectly straight, nor does it remain perfectly concentric within the packing when reciprocating or rotating. In fact, it tends to sway and press first against one side of the packing and then against another side, thereby pulling away slightly from one side of the packing. The pressurized well fluid can leak through this opening as a result. This fluid degrades the packing and also escapes from the wellhead. In addition the swaying of the rod string tends to wear the packing.

These problems are worse in the case where a downhole rotary pump is used to move the well fluid. These pumps, otherwise known as progressing cavity pumps, usually create greater pressure in the pumped fluid than is the case with reciprocating pumps. In addition, the rotating rod string which operates the pump tends to have a whipping motion which more severely works the packing and other seals. As a result, leakage is more of a problem with rotary pumps than it is with reciprocating pumps.

It is the objective of the present invention to provide a stuffing box, for use in the context of a rotating rod string, which is better able to resist leakage and seal wear.

SUMMARY OF THE INVENTION

The mechanical concept of the invention involves a combination of components and architecture, namely:

A tubular sleeve or mandrel having upper end and lower segments is provided to extend concentrically about the cylindrical polish rod of the rod string and to project downwardly into the stuffing box housing chamber. The lower segment of the mandrel is close-fitting around the polish rod;

Axially spaced bearings are positioned in the upper portion of the annular space which is formed between the outer surface of the lower segment of the mandrel and the inner surface of the housing. These bearings enable the mandrel to turn freely within the housing and they centralize and stabilize the mandrel and polish rod so that they run substantially true (that is, they do not sway or wobble to a significant extent);

A stationary non-compressed rotary seal is positioned in the annular space beneath the bearings. This rotary seal seals against the now-stabilized rotating surface of the mandrel, to contain the well fluid and to prevent it reaching the bearings along that surface;

Stationary static seal means are provided in the annular space beneath the bearings, to seal against the inner surface of the housing, to contain the well fluid and prevent it reaching the bearings along that surface;

(The stationary rotary seal and static seal means thus combine to form seal means extending between and contracting the mandrel and housing and positioned in the annular space below the bearings. The seal means functions to seal against the mandrel and housing, to contain well fluid);

The upper segment of the mandrel protrudes out of the upper end of the housing and has an increased bore diameter, so as to form a second annular space between the mandrel's inner surface and the polish rod's outer surface. Compressible packing is positioned in this second annular space and is supported at its bottom end by an internal radial shoulder formed by the mandrel; and Means for compressing the packing are provided at the upper end of the mandrel. Such means may comprise a tapered, split packing gland and an internally threaded compression nut for cooperating with external threads formed on the upper end of the protruding end of the mandrel to advance the packing gland downwardly to compress the packing against the radial shoulder. The compression means act to extrude the packing radially, to sealably engage the polish rod surface and the inside surface of the mandrel. The advancement of the tapered packing gland frictionally engages the packing it with the outer surface of the polish rod and the inner surface of the mandrel. This results in a coupling of the mandrel and polish rod as they rotate. Preferably, a jam nut is provided to positively lock the compression nut in place once the above has taken place.

As a result of combining these features, the following have been achieved:

The packing now rotates with the rod string and provides a static secondary seal for the polish rod. The polish rod no longer rotates within the compressed packing, thus mechanical wear of the packing is minimized;

The seal against the rotating member is now provided by a stationary rotary seal acting against a stabilized and centralized mandrel; and The whipping action of the rod string is now stabilized.

By implementing these features, a stuffing box has been developed which better resists leakage and wear.

Broadly stated, the invention comprises a stuffing box for connection with the flow tee of a wellhead for the purpose of sealing around the cylindrical polish rod of a rotating rod string extending through the wellhead, said stuffing box, when assembled, comprising: a generally tubular, outer housing attachable to the flow tee and forming an internal chamber; a generally tubular, freely rotatable, inner mandrel extending into the chamber of the housing and combining therewith to form a first annular space therebetween, said mandrel having an inner surface forming an axial bore of circular cross-section through which the polish rod will extend, said mandrel having an upper segment whose axial bore has a relatively expanded diameter so that a second annular space is formed between the polish rod and the upper segment inner surface for receiving compressible annular pacing, said mandrel further having a lower segment whose axial bore has a relatively reduced diameter so that the lower segment has a close fit with the polish rod; cap means, associated with the upper end of the housing, for closing the upper end of the first annular space; upper and lower bearing means, axially spaced apart and extending laterally between the housing and mandrel and being positioned in the upper portion of the first annular space, for centralizing and stabilizing the mandrel so that it runs substantially true when rotating; non-compressed, stationary rotary seal means, extending between and contacting the mandrel and housing and positioned in the first annular space below the bearing means, for sealing against the mandrel and housing to contain well fluid and prevent it accessing the bearing means; and compression means for compressing annular packing present in the second annular space to seal against the polish rod and the mandrel upper segment inner surface and for coupling the mandrel and polish rod so that they rotate together; said mandrel lower segment extending through the axially spaced apart bearing means and the rotary seal means.

DESCRIPTION OF THE PREFERRED EMBODIMENT

Figure 1:
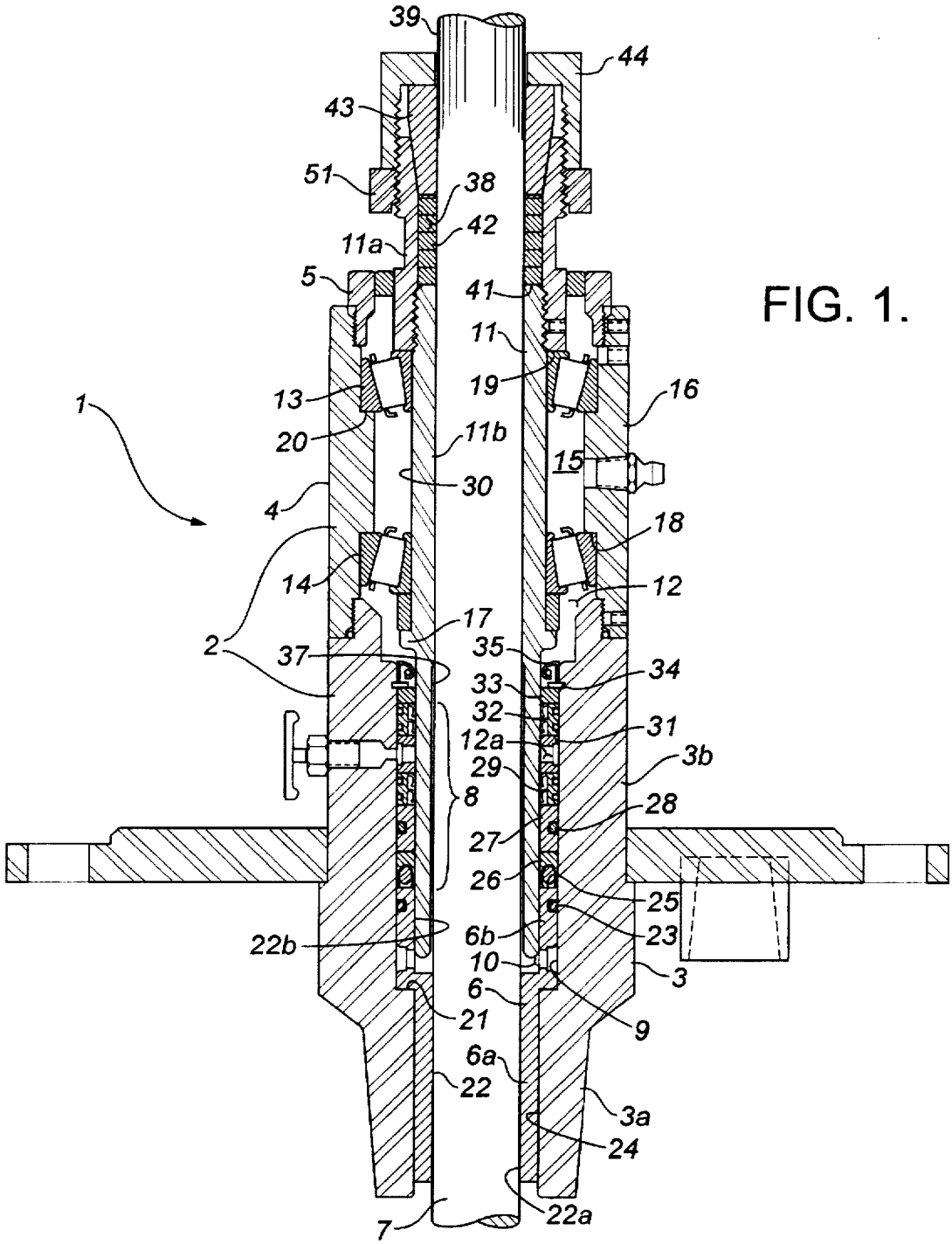
FIG. 1 is a sectional side view of a stuffing box in accordance with the invention.

Having reference to FIG. 1, a generally tubular stuffing box 1 is shown.

The stuffing box 1 comprises an outer, segmental housing 2 formed, from bottom to top, by a connector 3, a bearing housing 4 and a dust cap 5. These three parts are connected end-to-end by threaded connections.

The connector 3 includes an internal, tubular, bottom guide 6 formed of brass, for guiding the polish rod 7 and mandrel 11 and supporting a seal assembly 8.

The segmental housing 3 has an inner surface 9 forming an internal chamber 10 of circular section.

The stuffing box 1 further includes a tubular mandrel 11. This mandrel 11 extends down into the chamber 10 and combines with the housing inner surface 9 to form a first annular space 12.

Axially spaced apart, upper and lower thrust bearings -13, 14 are positioned in the bearing chamber 15, which is the upper portion of the annular space 12. These bearings 13, 14 are supported by the wall 16 of the bearing housing 4 and rotatably support, centralize and stabilize the mandrel 11. As shown, the lower bearing 14 is locked between a rib 17 carried by the mandrel 11 and an internal shoulder 18 formed by the housing wall 16. The upper bearing 13 is locked between an external shoulder 19 formed by the mandrel 11 and an internal shoulder 20 formed by the housing wall 16.

The guide 6 is considered for purposes of this description to be part of the connector 3, so as to form part of the segmental housing 2.

The guide 6 has a reduced outer diameter portion 6*a* and an expanded outer diameter portion 6*b*. The connector 3 has a reduced inner diameter portion 3*a* and an expanded inner diameter portion 3*b*. The housing portions 3*a*, 3*b* form a shoulder 21 at their juncture. The guide 6 seats on this shoulder 21.

The guide 6 has an internal bore 22 comprising a reduced diameter portion 22*a* and an expanded diameter portion 22*b*. The bore reduced diameter portion 22*a* is sized to closely fit the polish rod 7. The bore expanded diameter portion 22*b* is sized to receive and closely fit the lower end of the mandrel 11. Thus the guide 6 supports and guides both the polish rod 7 and the mandrel 11.

The guide 6 carries an O-ring 23 in its outer surface 24, for sealing against the inside surface 9 of the connector 3.

The guide 6 extends only part way up the length of the guide bore expanded diameter portion 22*b*. A narrow annular space 12*a* (forming part of annular space 12), is therefore formed between the connector 3 and the mandrel 11.

The stationary seal assembly 8 is positioned in the narrow annular space 12*a*. It is supported at its base by the guide end face 25.

The seal assembly 8 comprises a stack of annular seal elements. More particularly, from the bottom up it comprises: a seal 26 for filtering out particulates in the well fluid; a spacer 27 carrying an external O-ring 28, for preventing well fluid leakage along the housing inner surface 9; a high pressure lip seal cartridge 29 for sealing against the rotating outer surface 30 of the mandrel 11; and a lantern ring 31. The lantern ring 31 thus combines with the guide end face 25 to bracket the annular seal elements of the seal assembly 8 and retain them in position opposite the stabilized rotating outer surface 30 of the mandrel 11. The seal assembly 8 further comprises: a second lip seal cartridge 32 positioned on the lantern ring 31; a washer 33; a snap ring 34 seated in an internal groove formed by the housing surface 9; and a lip seal 35, for retaining lubricant in the bearing chamber 15 (which forms part of the first annular space 12).

In summary, the stationary seal assembly 8 closes the bottom end of the first annular space 12 and seals against the stabilized, centralized, rotating outer surface 30 of the mandrel 11. It also seals against the inner surface 9 of the segmental housing 2, to prevent well fluid leakage thereal-ong. In addition, it functions to retain lubricant in the bearing chamber 36.

The mandrel 11 comprises threadably connected upper and lower segments 11*a*, 11*b*. The upper segment 11 a protrudes above the housing 2. The lower segment 11*b* is located within the housing chamber 10.

The tubular mandrel 11 forms an axial bore 37. The diameter of the bore 37 in the mandrels' lower segment 11*b* is sized to provide a close fit around the polish rod 7. The diameter of the bore 37 formed by the mandrel upper segment 11*a* is relatively expanded. Therefore a second annular space 38 is formed between the polish rod's outer surface 39 and the inner surfaces 40, 40*a* of the mandrel upper segment 11*a*. A shoulder 41 is formed at the juncture of the mandrel segments 11*a*, 11*b*.

Figure 2:
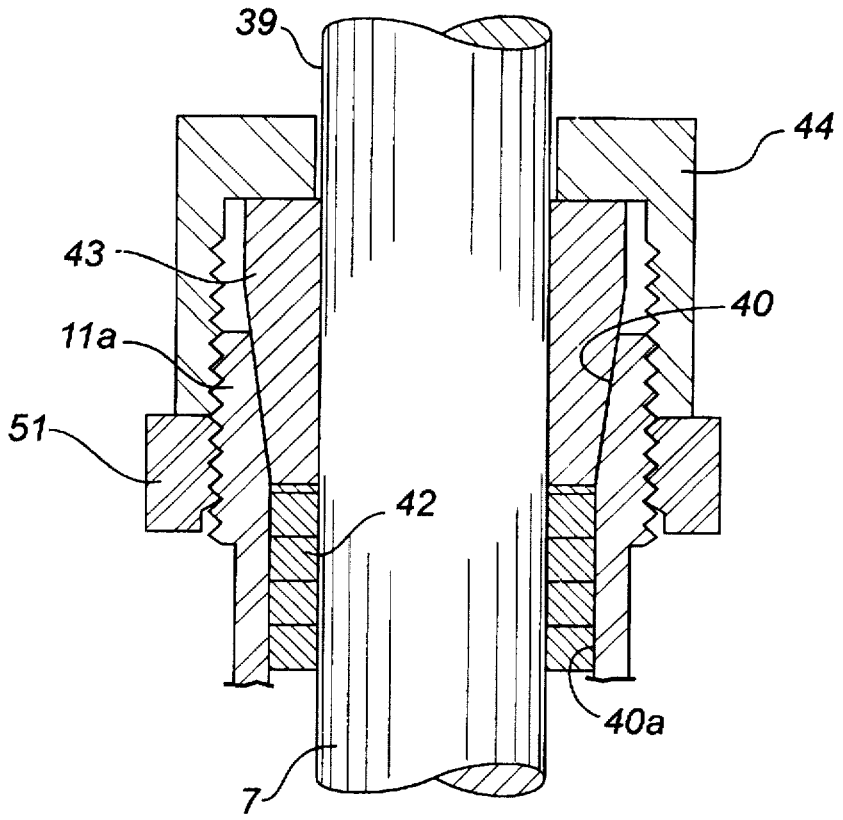
FIG. 2 is an expanded sectional side view of the upper end of the stuffing box, showing details of the split, tapered packing gland and the tapered inside surface of the mandrel.

The upper inner surface 40, of the mandrel upper segment 11*a*, is slightly inwardly tapered from the top down. This is shown in an exaggerated manner in FIG. 2. The lower inner surface 40*a* of the mandrel upper segment 11*a* is non-tapered.

Packing 42, comprising a stack of compressible annular packing rings, is positioned in the second annular space 38.

A tapered, longitudinally split, brass packing gland 43 extends downwardly into the upper end of the second annular space 38. An internally threaded compression nut 44 is provided to advance downwardly along the externally threaded mandrel upper segment 11*a*. When the compression nut 44 is advanced downwardly, it biases the packing gland 43 downwardly to compress the packing 42. The packing 42 expands radially and seals around the polish rod surface 39 and against the nontapered inner surface 40*a* of the mandrel upper segment 11*a*. At the same time, the tapered packing gland 43 wedges against the polish rod 7 and the tapered surface 40 of the mandrel upper segment 11*a* to frictionally couple them together so that they rotate as a unit. The jam nut 51 is then tightened against the compression nut 44 to lock it in place.

In operation, the mandrel 11 is coupled to and rotates with the polish rod 7. The packing 42 provides a seal to prevent fluid leakage along the polish rod 7. The bearings 13, 14 stabilize and centralize the mandrel 11. The stationary seal 8 seals against the stabilized and centralized mandrel 11 and prevents leakage along the housing inner surface 9 and mandrel outer surface 30.

The upper end of the first annular space 12 is closed by the cap 5, which is threaded into the bearing housing 4. The cap 5 carries a lip seal 46 to contain the lubricant in the bearing chamber 15.

The expression "close fit" has been used several times in the description and appears in the claim. The phrase is to be interpreted broadly. The fit or clearance between the rotating mandrel and the brass guide is preferably selected to permit rotation while maintaining desirable support. The clearance between polish rod and mandrel is preferably selected so that the latter supports the former.

The scope of the invention is defined by the claims now following:

The embodiments of the invention in which an exclusive property or privilege is claimed are defined as follows:

1. A stuffing box for connection with the flow tee of a wellhead for the purpose of sealing around the cylindrical polish rod of a rotating rod string extending through the wellhead, said stuffing box, when assembled, comprising:

a generally tubular, outer housing attachable to the flow tee and forming an internal chamber;

a generally tubular, freely rotatable, inner mandrel extending into the chamber of the housing and combining therewith to form a first annular space therebetween, said mandrel having an inner surface forming an axial bore of circular cross-section through which the polish rod will extend, said mandrel having an upper segment whose axial bore has a relatively expanded diameter so that a second annular space is formed between the polish rod and the upper segment inner surface for receiving compressible annular packing, said mandrel further having a lower segment whose axial bore has a relatively reduced diameter so that the lower segment has a close fit with the polish rod;

cap means, associated with the upper end of the housing, for closing the upper end of the first annular space;

upper and lower bearing means, axially spaced apart and extending laterally between the housing and mandrel and being positioned in the upper portion of the first annular space, for centralizing and stabilizing the mandrel so that it runs substantially true when rotating;

non-compressed, stationary rotary seal means, extending between and contacting the mandrel and housing and positioned in the first annular space below the bearing means, for sealing against the mandrel and housing to contain well fluid and prevent it accessing the bearing means; and compression means for compressing annular packing present in the second annular space to seal against the polish, rod and the mandrel upper segment inner surface and for coupling the mandrel and polish rod so that they rotate together;

said mandrel lower segment extending through the axially spaced apart bearing means and the rotary seal means.

2. The stuffing box as set forth in claim 1 wherein the rotary seal means comprises at least one high Pressure lip seal cartridge.

* * * * *